US005518473A

United States Patent [19]

Miller

[11] Patent Number: 5,518,473

[45] Date of Patent: May 21, 1996

[54] EXERCISE DEVICE

[76] Inventor: Larry Miller, 1628 Treeside, Rochester, Mich. 48307

[21] Appl. No.: 407,272

[22] Filed: Mar. 20, 1995

[51] Int. Cl.[6] ..... A63B 69/16; A63B 22/04

[52] U.S. Cl. ..... 482/57; 482/51; 482/52

[58] Field of Search ..... 482/51, 57, 70, 482/52, 53, 71, 62, 111, 72, 60

[56] References Cited

U.S. PATENT DOCUMENTS

| | | | |
|---|---|---|---|
| 219,439 | 9/1879 | Blend . | |
| 2,603,486 | 7/1952 | Hughes | 272/79 |
| 3,316,898 | 5/1967 | Brown | 128/25 |
| 3,759,511 | 9/1973 | Zinkin et al. | 272/58 |
| 4,509,742 | 4/1985 | Cones | 272/73 |
| 4,645,200 | 2/1987 | Hix | 272/73 |
| 4,720,093 | 1/1988 | DelMar | 272/70 |
| 4,869,494 | 9/1989 | Lambert, Sr. | 272/73 |
| 4,949,954 | 8/1990 | Hix | 272/73 |
| 5,039,088 | 8/1991 | Shifferaw | 282/73 |
| 5,242,343 | 9/1993 | Miller | 482/47 |
| 5,279,529 | 1/1994 | Eschenbach | 482/51 |
| 5,290,211 | 3/1994 | Stearns | 482/51 |
| 5,299,993 | 4/1994 | Habing | 482/51 |
| 5,352,169 | 10/1994 | Eschenbach | 482/57 |
| 5,383,829 | 1/1995 | Miller | 482/57 |

FOREIGN PATENT DOCUMENTS

| | | | |
|---|---|---|---|
| 2919494 | 11/1980 | Germany | 482/57 |

*Primary Examiner*—Stephen R. Crow

*Attorney, Agent, or Firm*—Gifford, Krass, Groh, Sprinkle, Patmore, Anderson & Citkowski

[57] ABSTRACT

An exercise device includes a frame which supports a pair of foot links so that a first end of each foot link is pivotably coupled to the frame for motion about an arcuate path. A guide which is supported by the frame engages each foot link and directs a second end of each foot link along a closed, curved, generally teardrop shaped path of travel. This combination of motions defined by the foot link provides a natural running and stepping motion in which the heel of a user's foot initially rises faster than the toe as the foot move begins to forward and subsequently falls faster than the toe as the foot begins to move backward.

7 Claims, 2 Drawing Sheets

FIG - 2A
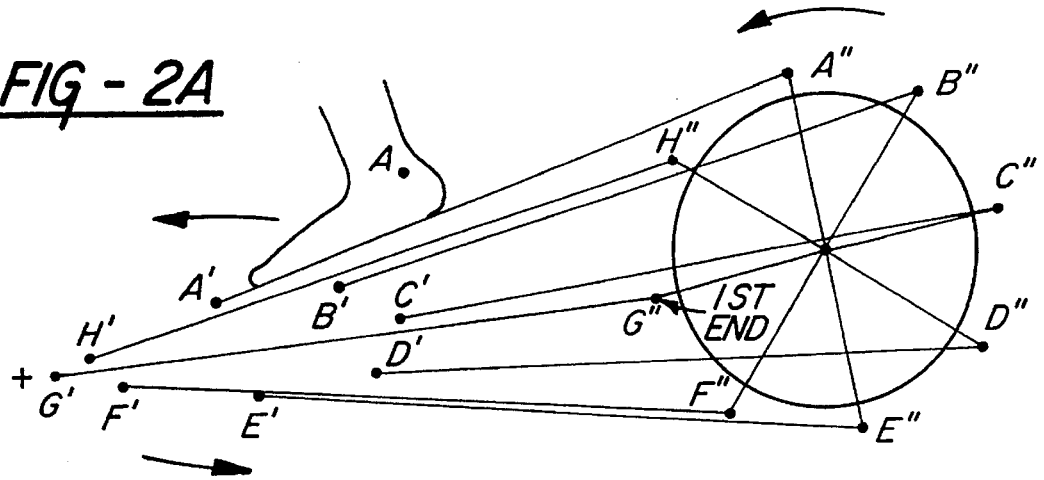
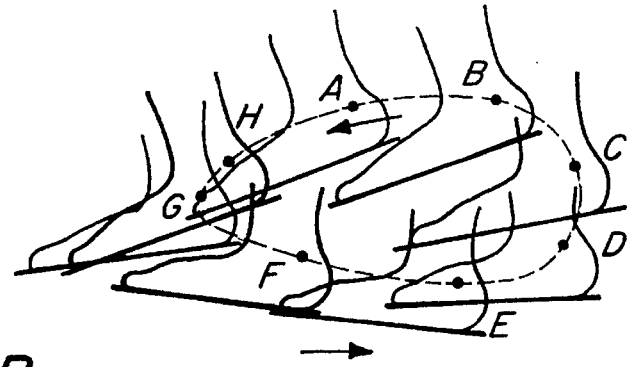
FIG - 2B
FIG - 3
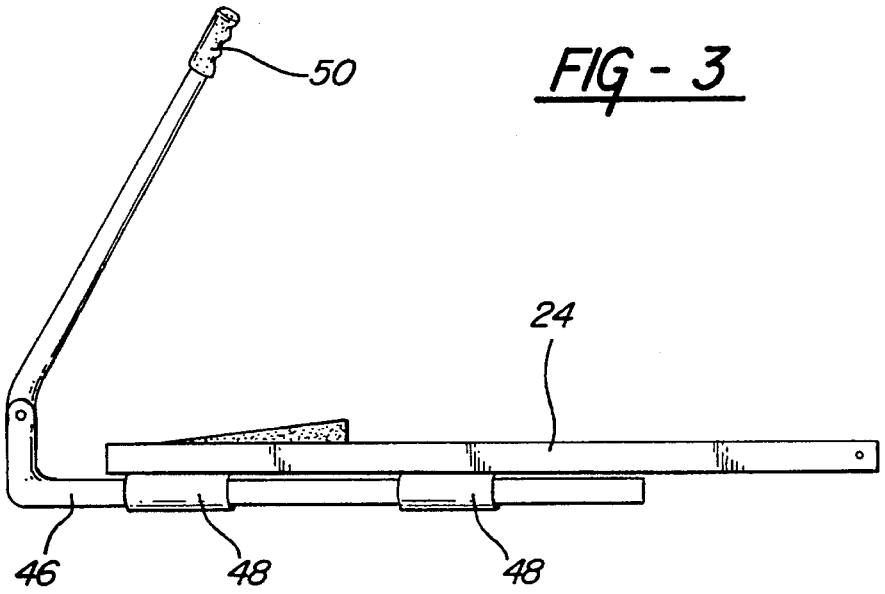

EXERCISE DEVICE

FIELD OF THE INVENTION

This invention relates generally to exercise equipment. More specifically, the invention relates to a stationary exercise device for simulating running and stepping motions.

BACKGROUND OF THE INVENTION

Because of a growing appreciation for the benefits of regular exercise; and because constraints of time and space prevent many persons from indulging in activities such as running, swimming and walking, the market for exercise equipment is rapidly increasing. It is generally desirable to exercise a number of different muscles over a fairly large range of motion so as to provide for even physical development and a maximum level of aerobic exercise. It is further desirable that exercise equipment provide a smooth, relatively natural motion so as to avoid jarring or irregular strains which can damage muscles and joints. It is also desirable that exercise equipment be relatively easy to use and of simple, low cost construction.

While a number of different exercise systems are known in the prior art, such systems suffer from a number of shortcomings which limit their utility. Stationary bicycles are widely used; however, they are employed in a sitting position and consequently, the number of muscles exercised is small. Furthermore, the range of motion provided by a stationary bicycle is fairly limited. Stationary devices for simulating cross country skiing are also in widespread use. While these systems exercise more muscles than do stationary bicycles, the relatively flat, shuffling foot motion provided thereby does not adequately exercise all of the leg muscles through a wide range of motion. Stair climbing equipment also exercises more muscles than do stationary bicycles; however, the rather limited up and down motion provided thereby does not exercise leg muscles through a large range of motion. Treadmills and the like permit walking or jogging in a relatively limited area; however, they can be quite jarring to knee and ankle joints, and many users find it difficult to maintain balance on a treadmill.

U.S. Pat. No. 4,720,093 shows a climbing type exerciser. U.S. Pat. No. 4,509,742 shows a stationary bicycle which provides for arm motion. U.S. Pat. No. 2,603,486 shows a bicycle type exerciser providing for combining arm and leg motions. U.S. Pat. No. 5,039,088 shows another bicycle type exerciser providing for hand motion.

U.S. Pat. No. 3,316,898 discloses a rehabilitation device for passive use by a seated person. The device includes a motor which raises and lowers a set of foot supporting plates so as to flex the ankle, knee and hip joints. German Laid Open Publication 29 19 494 discloses an exercise device in which a set of foot supporting plates are disposed so as to undergo a combination of sliding and rotary motion to provide a stepping action. It has been found that while both of these apparatus produce a stepping motion, the motion does not simulate natural running and walking.

In response to the shortcomings of the prior art, the inventor of the present invention has previously developed a stationary exercise device which is disclosed in U.S. Pat. Nos. 5,242,343 and 5,383,829. The devices disclosed therein each include a set of elongated foot links, one end of which rotates while the other end reciprocates. The apparatus of the foregoing patents provides a natural running and stepping motion in which the user's heel initially rises at a faster rate than the toe, on a forward step, and in which the heel initially falls at a faster rate than the toe on a backward step. The present invention is directed to an exercise device which is configured differently from those in U.S. Pat. Nos. 5,242,343 and 5,383,829, but which achieves a similar, beneficial foot action.

The apparatus of the present invention is simple to manufacture and use and provides a smooth; natural action which exercises a relatively large number of muscles through a large range of motion. These and other advantages of the present invention will be readily apparent from the drawings, discussion and description which follow.

BRIEF DESCRIPTION OF THE INVENTION

There is disclosed herein an exercise device which comprises a frame configured to be supported on a floor and including a pivot axis defined thereon. The device further includes a first and a second foot link, and each foot link includes a first end, a second end and a foot engaging portion therebetween. A coupling member associated with the first end of each foot link pivotally couples the first end to the pivot axis at a predetermined distance therefrom so that the first end of each foot link travels in an arcuate path about the axis. The exercise device also includes a first and a second guide, each of which is supported by the frame and configured to engage a respective one of the foot links. The guides direct a second end of each foot link along a closed, curved path of travel as the first end of the foot link travels along the arcuate path. When the device is in use, and when a foot of a user which is disposed upon the foot engaging portion travels forward, from a rearmost position, the heel of the foot initially rises at a faster rate than the toe, and when the foot travels rearward, from a foremost position, the heel initially lowers at a faster rate than the toe.

The guides may include rollers for directing the foot links, and in one particular embodiment, the guides each include a rocker arm pivotably supported by the frame. The rocker arm slidably engages the foot link, preferably through a set of rollers, so as to direct the second end of the foot link in a closed, curved pain of travel. In certain embodiments; the foot links are configured so that the user's foot is disposed with a heel portion closest to the first end of the foot link and a toe portion closest to the second end of the foot link. In some embodiments, the frame may include a hand support affixed thereto. In some embodiments, the hand support may move in conjunction with the foot links to provide upper body exercising.

BRIEF DESCRIPTION OF THE DRAWINGS

FIG. 2A depicts the foot link action provided by the present invention;

FIG. 2B depicts the foot action provided by the present invention; and

FIG. 3 depicts an alternative embodiment of guide member structured in accord with the present invention.

DETAILED DESCRIPTION OF THE INVENTION

Figure 1:
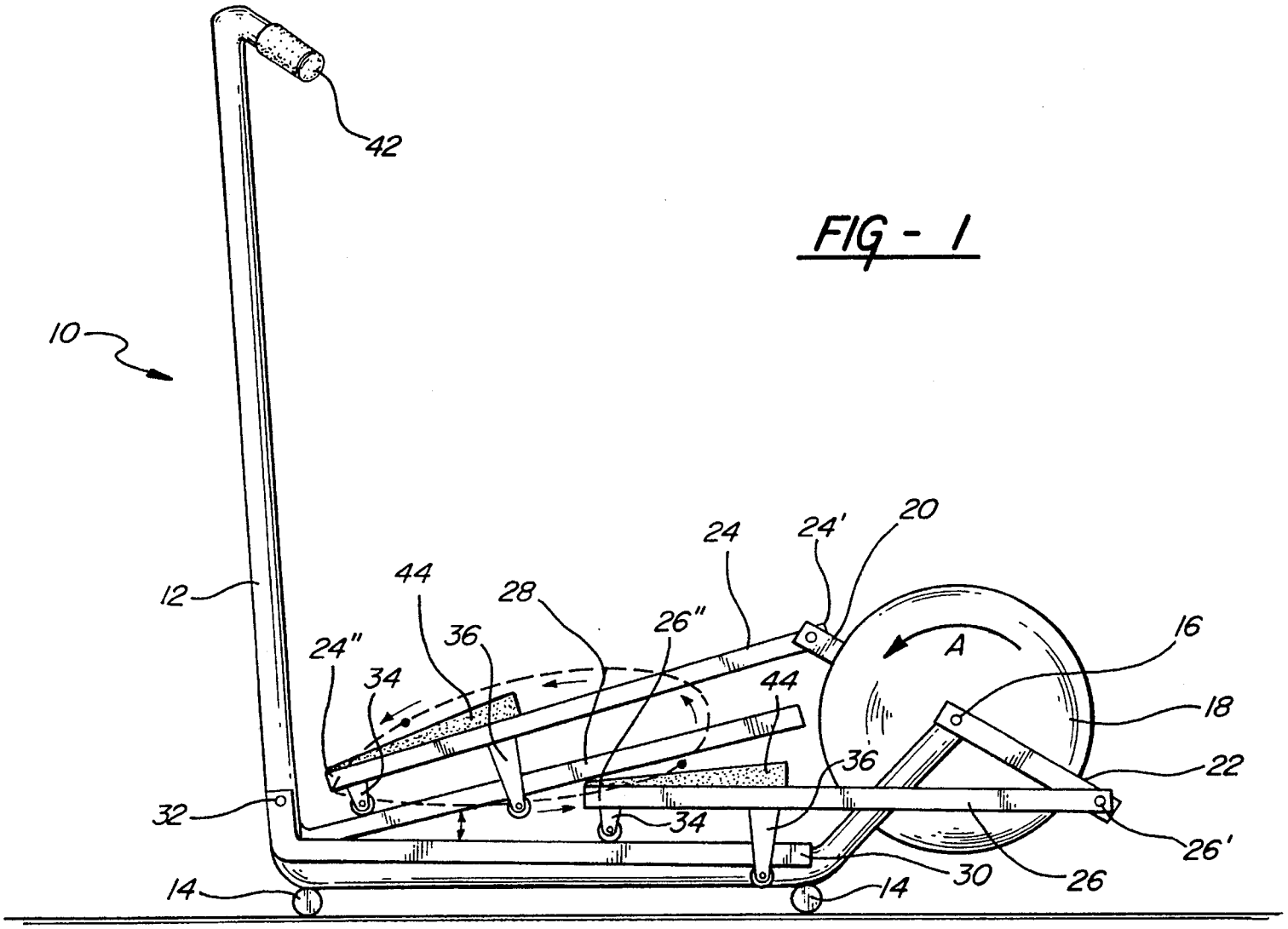
FIG. 1 depicts one embodiment of exercise device structured in accord with the principles of the present invention.

The present invention is directed to an exercise apparatus which provides natural stepping and running action. The configuration of the apparatus of the present invention causes a user's foot to move in a generally oval path of travel in which the heel initially rises at a faster rate than the toe at the beginning of a forward step and falls at a faster rate than the toe at the beginning of a rearward step. This natural action exercises lower body muscles in a manner which closely approximates a natural running or walking motion.

Referring now to FIG. 1, there is shown one embodiment of exercise device 10 constructed in accord with the principles of the present invention. The device 10 of FIG. 1 includes a frame 12 configured to be supported on a floor, as for example by means of a pair of legs 14. The frame 12 has a pivot axis defined at one end thereof as for example by a shaft 16. In the depicted embodiment, a fly wheel 18 is supported on the frame 12 by the shaft 16 for rotation about the pivot axis.

The exercise device 10 of FIG. 1 further includes a pair of foot links 24, 26, each of which comprises a generally elongated member having a first end 24', 26' coupled to the pivot axis. In the illustrated embodiment, a pair of bell cranks 20, 22 function as coupling members for pivotally connecting the foot links 24, 26 to the pivot axis.

The bell cranks 20, 22 constrain the first ends 24', 26' of the respective foot links to travel about the pivot axis in an arcuate path of travel. In the illustrated embodiment, the path of travel is a generally circular path of travel. Within the context of this disclosure, an arcuate path of travel refers to a circular path; an oval path or any other such path of travel. In the most preferred embodiment, the path of travel will be a circular or oval path of travel.

In accord with the present invention, the exercise device 10 includes a set of guides which direct second ends 24", 26" of the foot links along a closed, curved path of travel. In the FIG. 1 embodiment, the guides include a first rocker arm 28 and a second rocker arm 30. Each of the rocker arms is pivotally supported on the frame 12 by a shaft 32. As illustrated, each foot link 24, 26 has a pair of roller assemblies 34, 36 supported thereupon. A first roller assembly 34 engages an upper surface of one of the rocker arms and a second roller assembly 36 engages a lower surface of the same rocker arm.

When the apparatus of FIG. 1 is in use, the fly wheel 18 rotates in the direction indicated by arrow A, and as it rotates the associated bell crank moves the first end of each of the foot links 24, 26 in a circular path of travel thereby raising and lowering that first end as well as advancing it in a forward and rearward direction. As the foot link 24 moves forwardly and rearwardly, the rocker arm 28 is raised and lowered by the action of the roller assemblies 34, 36 which also guide and support the foot links. The rocker arm 28 causes the second end 24" of the foot link 24 to travel in a closed, curved path of travel as shown at reference numeral 40. As illustrated, this path of travel 40 is a generally teardrop shaped path. This path of travel is in contrast to the reciprocal path of travel attained by the foot links in the apparatus of U.S. Pat. Nos. 5,242,343 and 5,383,829.

As a result of the configuration of the apparatus of FIG. 1, a user's foot follows a very natural path of motion when the apparatus is used. Referring now to FIGS. 2A and 2B, there is shown a diagram illustrating foot motion of the foot and foot link, as the device of FIG. 1 moves a foot link through one complete cycle. FIG. 2A shows the motion of the foot link as the flywheel rotates and the first end thereof cycles through positions A" to H" and the second end cycles through positions A' to G'. FIG. 2B shows corresponding motion of the user's foot.

For purposes of illustration, the cycle is shown as beginning at point C where the foot is at its rearmost position. As the foot link moves forward to position B, the foot begins to rise, and the heel rises faster than the toe. The foot continues on forward through position A and position H. At position G, the foot is in the approximate foremost position and begins to travel rearwardly again. As the foot travels from position G to position F, the heel falls at a rate faster than the toe. This illustrated action simulates the natural stride attained in running and stepping. At the same time, the first end of the foot link traces out a circular path from C" to D", and the second end of the foot link traces a closed, curved path from C' to D'.

Referring back to FIG. 1, it will be noted that the exercise device 10 includes a hand grip portion 42 supported on the frame 12. This hand grip is an optional feature of the present invention and steadies the user. Other optional features include wedge shaped foot pads 44 associated with each of the foot links 24, 26. The foot pads 44 may optionally be cushioned and provide for a slight degree of foot elevation so as to properly adjust the stride angle of the user. The foot pads 44 may be made height adjustable. In those instances, as described below, where the frame 12 itself is capable of being elevated, or where the angular position of the foot links can be otherwise changed, the foot pads will not be necessary.

Other variations and modifications of the FIG. 1 apparatus may be implemented within the scope of the present invention. For example, the frame 12 may be provided with height adjustment means for selectively elevating the front and/or rear of the frame. Such height adjustment means may include a manual, or powered jack associated with, or replacing the support feet 14. Likewise, the height of the handle 42 may be adjustable. In some embodiments, a motor may be provided for driving the foot links. In other embodiments, it may be desirable to eliminate the fly wheel 18. Although not illustrated, a brake or drag mechanism may be associated with the fly wheel for increasing the amount of work required to propel the apparatus.

Various configurations of guides may also be implemented in accord with the present invention. For example, FIG. 3 depicts another embodiment of guide structured as a rocker arm 46 having a foot link 24 slidably attached thereto the means of sleeves 48. The sleeves 48 are affixed to the foot link 24 and provide a bearing surface which permits relative sliding motion of the rocker arm 46 and foot link 24. It will be appreciated that bearings such as ball bearings, roller bearings or the like may be disposed in the sleeve 48 to decrease sliding friction. It will also be appreciated that a single sleeve may be employed, as may be three or more sleeves. In the FIG. 3 embodiment, the rocker arm 46 includes a handle portion 50 integral therewith. This handle will move back and forth as the rocker arm moves up and down. In the illustrated embodiment, the handle is offset in a direction transverse to the length of the rocker arm so that it can be engaged by the right arm of a user when the user's left arm engages the foot link 24; furthermore, the handle is bent away from the vertical so as to properly position the hand grip with respect to the user. In this manner, the exercise device provides upper body motion.

Other variations will be readily apparent to one of skill in the art. For example, the rocker arm may slide in a groove formed in the foot link, or conversely the rocker arm may be provided with a groove which receives a corresponding portion of the foot link. A series of rollers may be supported in the rocker arm, and the foot link may glide on these rollers. Yet other variations of guide may be constructed in accord with the principles of the present invention provided they function to direct the second end of the foot link in a closed, curved path of travel such that proper foot motion is achieved. For example, the rocker arm may be eliminated and a roller member pivotally affixed to the frame. In such instance, the foot link will glide over the roller so as to provide the requisite foot action.

In view of the disclosure and discussion presented herewith, it will be appreciated that yet other embodiments of exercise device in accord with the present invention will be readily apparent to one of skill in the art. The foregoing drawings, discussion and description are merely meant to exemplify particular embodiments of the present invention and are not meant to be a limitation upon the practice thereof. It is the following claims, including all equivalents, which define the scope of the invention.

I claim:

1. An exercise device comprising:

a frame having a pivot axis defined thereon, said frame configured to be supported on a floor;

a first and a second foot link, each foot link including a first end, a second end and a foot engaging portion therebetween;

a coupling member associated with the first end of each foot link for pivotally connecting said first end to said pivot axis at a predetermined distance therefrom so that said first end travels in an arcuate path about said axis;

a first and a second guide, each guide being pivotally supported by said frame and configured to engage a respective one of said foot links through at least one roller element and to direct the second end thereof along a closed, curved path of travel as the first end of said respective one of said foot links travels along said arcuate path; so that when the exercise device is in use, and when a foot of a user which is disposed upon the foot engaging portion of a foot link travels forward, from a rearmost position, a heel portion of the foot initially rises at a faster rate than a toe portion thereof, and when the foot travels rearward, from a foremost position, the heel portion thereof initially lowers at a faster rate than the toe portion.

2. An exercise device as in claim 1, wherein said guides each include a rocker arm pivotally supported by said frame.

3. An exercise device as in claim 1, wherein said at least one roller element is supported by said respective foot link.

4. An exercise device as in claim 1, wherein the foot engaging portion of each foot link is configured so that when the exercise device is in use, the user's foot is disposed with the heel portion thereof closest to the first end of the foot link and the toe portion thereof closest to the second end of the foot link.

5. An exercise device as in claim 7, further including a handle supported by said frame proximate the second ends of the foot links.

6. An exercise device as in claim 2, wherein each rocker arm includes a hand grip coupled thereto.

7. An exercise device comprising:

a frame having a pivot axis defined thereon, said frame configured to be supported on a floor;

a first and a second foot link, each foot link including a first end, a second end and a foot engaging portion therebetween, said foot engaging portion being configured so that when the exercise device is in use, a user's foot is disposed with a heel portion thereof closest to the first end of the foot link and a toe portion closest to the second end of the foot link;

a coupling member associated with the first end of each foot link for pivotally coupling said first end to said pivot axis at a predetermined distance therefrom, so that said first end travels in an arcuate path about said axis;

a first and a second guide, each guide being pivotally connected to the frame and operative to slidably engage a respective one of said first and second foot links and to direct the second end thereof along a closed, curved path of travel as the first end of said respective foot link travels along said arcuate path.

* * * * *